US009203165B2

(12) United States Patent
Farole

(10) Patent No.: US 9,203,165 B2
(45) Date of Patent: Dec. 1, 2015

(54) ELECTRICAL CONNECTOR AND CONTACT FOR INTERCONNECTING DIFFERENT COMPONENTS

(71) Applicant: Tyco Electronics Corporation, Berwyn, PA (US)

(72) Inventor: Dominic Anthony Farole, Hummelstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 53 days.

(21) Appl. No.: 14/088,106

(22) Filed: Nov. 22, 2013

(65) Prior Publication Data

US 2015/0011113 A1 Jan. 8, 2015

Related U.S. Application Data

(60) Provisional application No. 61/843,210, filed on Jul. 5, 2013.

(51) Int. Cl.

| | |
|---|---|
| ***H01R 4/24*** | (2006.01) |
| ***H01R 12/72*** | (2011.01) |
| ***H01R 12/73*** | (2011.01) |
| ***H01R 12/75*** | (2011.01) |

(52) U.S. Cl.

CPC ..... *H01R 4/2454* (2013.01); *H01R 12/721* (2013.01); *H01R 12/732* (2013.01); *H01R 12/75* (2013.01)

(58) Field of Classification Search

CPC ..... H01R 12/675; H01R 12/00; H01R 12/71; H01R 12/714; H01R 13/514; H01R 13/518; H01R 13/112; H01R 13/506; H01R 23/6806; H01R 23/6893; H01R 23/70; H01R 4/2454; H01R 4/2429

USPC ..... 439/387, 389, 395, 397, 398, 404, 443, 439/409, 410, 402, 701, 717, 630, 59, 260, 439/108

See application file for complete search history.

(56) References Cited

U.S. PATENT DOCUMENTS

| | | | | |
|---|---|---|---|---|
| 4,701,002 | A * | 10/1987 | Mouissie | 439/426 |
| 4,986,779 | A * | 1/1991 | Ferrill et al. | 439/108 |
| 6,875,044 | B1 | 4/2005 | Lee | |

(Continued)

FOREIGN PATENT DOCUMENTS

| | | | |
|---|---|---|---|
| FR | 2975538 | A3 | 11/2012 |
| WO | 9614671 | A1 | 5/1996 |

OTHER PUBLICATIONS

International Search Report, International Application No. PCT/US2014/045198, International Filing Date Jul. 2, 2014.

*Primary Examiner* — Amy Cohen Johnson
*Assistant Examiner* — Oscar C Jimenez

(57) ABSTRACT

Electrical connector including a connector body having an engagement side and a contact cavity that opens to the engagement side. The contact cavity includes a wire-receiving slot that is shaped to receive a wire conductor and a board-receiving slot that is shaped to receive a circuit board. The electrical connector also includes an electrical contact held by the connector body within the contact cavity. The electrical contact includes a spring member and an insulation displacement contact (IDC) channel. The spring member extends into the board-receiving slot to engage the circuit board. The IDC channel opens to the wire-receiving slot to receive the wire conductor.

19 Claims, 11 Drawing Sheets

(56) References Cited

U.S. PATENT DOCUMENTS

2008/0166923 A1 7/2008 Denter
2008/0305661 A1* 12/2008 Neumetzler ..... 439/92
2010/0035443 A1* 2/2010 Daily ..... 439/59
2012/0149233 A1* 6/2012 Hsueh ..... 439/395
2012/0270433 A1* 10/2012 Myer et al. ..... 439/404

* cited by examiner

ELECTRICAL CONNECTOR AND CONTACT FOR INTERCONNECTING DIFFERENT COMPONENTS

CROSS-REFERENCE TO RELATED APPLICATION

The present application claims the benefit of U.S. Provisional Application No. 61/843,210, filed on Jul. 5, 2013, which is incorporated herein by reference in its entirety.

BACKGROUND OF THE INVENTION

The subject matter herein relates generally to an electrical connector having contacts for transmitting data signals or power between different electrical components.

Electrical connectors are used to interconnect different electrical components to transmit current therebetween in the form of power or data signals. Electrical components that may be interconnected include circuit boards, wires, other electrical connectors, devices, power supplies, and the like. Electrical connectors have interfaces that are configured to mate with other complementary interfaces. A connector interface includes conductive elements and typically non-conductive elements that engage another interface of an electrical component. For example, a connector interface may include an electrical contact that directly engages a conductive element of the electrical component. In addition, the connector interface may include structurally-defined features (e.g., surfaces along a side of the connector, guide features, housing cavities, latches, etc.) that are configured to facilitate a mating operation between the electrical connector and the component. The structurally-defined features may also facilitate maintaining the interconnection after the mating operation so that the components do not inadvertently disengage. For instance, a card connector may have interior surfaces that define a slot and that are shaped to direct a circuit board as the circuit board is inserted into the slot. The interior surfaces effectively align the contact pads of the circuit board with the electrical contacts of the card connector and hold the circuit board in a designated orientation after the mating operation.

Connector interfaces of conventional electrical connectors, however, are typically configured to engage only one type of electrical component. For example, one type of connector interface may include insulation displacement contacts (IDCs) that receive insulated wires and slice through the insulation of the wires to directly engage a conductor surrounded by the insulation. Another type of connector interface may be the connector interface of the card connector described above. Card connectors typically include a slot that is dimensioned to receive a printed circuit board (PCB).

Because the connector interfaces of conventional electrical connectors are designed to engage only one type of electrical component, such electrical connectors lack versatility. Accordingly, it may be necessary for manufacturers to purchase several different types of electrical connectors for a single system. It may be less costly, however, for a manufacturer to purchase a greater number of a more versatile connector and use that connector for multiple purposes.

Accordingly, there is a need for an electrical connector having a connector interface that is capable of mating with different types of electrical components.

BRIEF DESCRIPTION OF THE INVENTION

In one embodiment, an electrical connector is provided that includes a connector body having an engagement side and a contact cavity that opens to the engagement side. The contact cavity includes a wire-receiving slot that is shaped to receive a wire conductor and a board-receiving slot that is shaped to receive a circuit board. The electrical connector also includes an electrical contact held by the connector body within the contact cavity. The electrical contact includes a spring member and an insulation displacement contact (IDC) channel. The spring member extends into the board-receiving slot to engage the circuit board. The IDC channel opens to the wire-receiving slot to receive the wire conductor.

In another embodiment, an electrical connector is provided that includes a connector body having first and second engagement sides and a contact cavity that extends between the first and second engagement sides. The electrical connector also includes an electrical contact having a bridge portion and first and second engagement portions that are joined by the bridge portion. The electrical contact is disposed within the contact cavity and held by the connector body such that the first and second engagement portions are positioned proximate to the first and second engagement sides, respectively. The first engagement portion includes a spring member and an insulation displacement contact (IDC) channel. The second engagement portion includes at least one termination feature. The first engagement portion and the first side form a first connector interface, and the second engagement portion and the second side form a second connector interface. The second connector interface is configured to engage an electrical component. The first connector interface is configured to engage a wire conductor with the IDC channel and a modular component with the spring member.

In another embodiment, an electrical connector is provided that includes a connector body having first and second engagement sides. The first side includes a wire-receiving slot and a board-receiving slot. The board-receiving slot is shaped to receive a circuit board, and the wire-receiving slot is shaped to receive a wire conductor. The second side has an opening configured to receive an electrical component. The electrical connector also includes a conductive circuit that is held by the connector body and extends between the first and second engagement sides. The conductive circuit includes first, second, and third termination features. The first and second termination features are located within the wire-receiving and board-receiving slots, respectively, proximate to the first side. The third termination feature is located proximate to the second side, wherein the first and second termination features share a common transmission pathway through the conductive circuit to the third termination feature.

In yet another embodiment, an electrical contact is provided that includes a single elongated contact body formed from conductive material. The contact body includes first and second engagement portions and a bridge portion that joins the first and second engagement portions. Each of the first and second engagement portions of the electrical contact include an insulation displacement contact (IDC) channel that is configured to receive a wire conductor. At least one of the first and second engagement portions includes a resilient spring member that is configured to engage a circuit board.

DETAILED DESCRIPTION OF THE INVENTION

Embodiments described herein include electrical connectors and contacts in addition to systems and assemblies including the same that are configured to transmit current in the form of data signals or power. In some embodiments, the electrical connector may have a single connector interface that is capable of engaging multiple types of electrical components (or multiple types of interfaces). By way of example only, a single connector interface may be along one engagement side of a connector body and be capable of engaging a circuit board and a wire conductor (e.g., insulated wire) at separate times or, optionally, at the same time. In some embodiments, the electrical connectors may have multiple connector interfaces in which at least one of the connector interfaces is configured to engage multiple types of electrical components, such as a circuit board and wire conductor.

When two connector interfaces are engaged to corresponding electrical components or when one connector interface is engaged to two electrical components, electrical current may be transmitted through the electrical connector between the electrical components. Non-limiting examples of the types of interconnections that may be established by embodiments set forth herein include printed circuit board (PCB) to insulation displacement contact (IDC) interconnections, PCB-PCB interconnections, and IDC-IDC interconnections.

Embodiments include conductive circuits that have multiple termination features. As used herein, termination features are part of a transmission pathway and include conductive surfaces that are configured to directly engage (e.g., mechanically and electrically) another conductive element to establish an electrical connection. For instance, a termination feature may include an insulation displacement contact (IDC) channel having opposing surfaces that directly engage and grip a wire conductor therebetween. Termination features may also include spring members that have mating ends that directly engage conductive elements of an electrical component, such as contact pads of a circuit board. Other types of termination features may be used in the conductive circuit. As used herein, a conductive circuit may include a single electrical contact having the multiple termination features or a plurality of conductive elements that are coupled together to form the conductive circuit having the multiple termination features.

Figure 1:
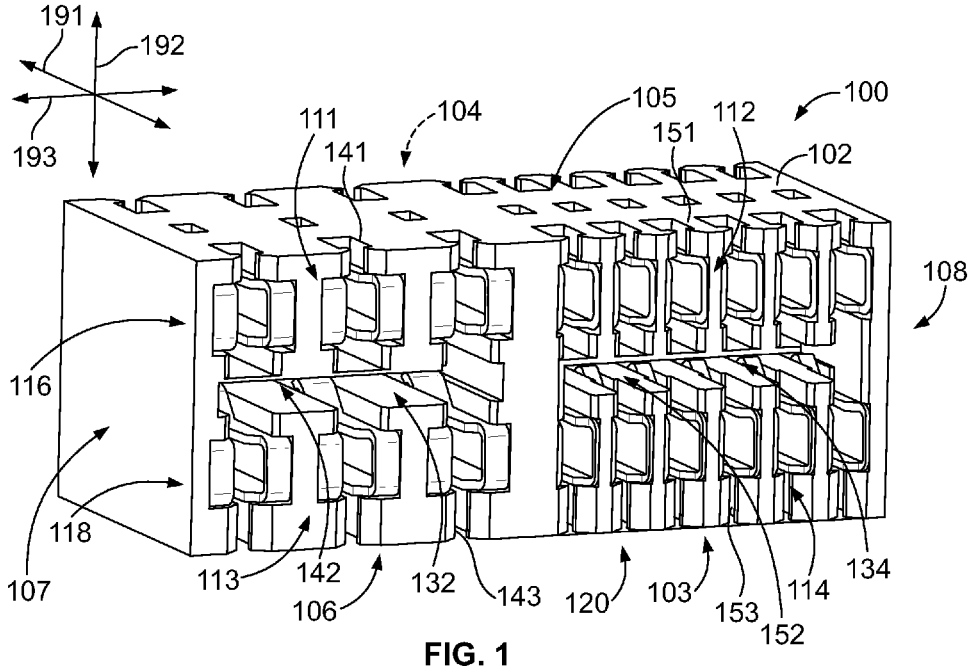
FIG. 1 is a front-perspective view of an electrical connector formed in accordance with one embodiment.
Figure 2:
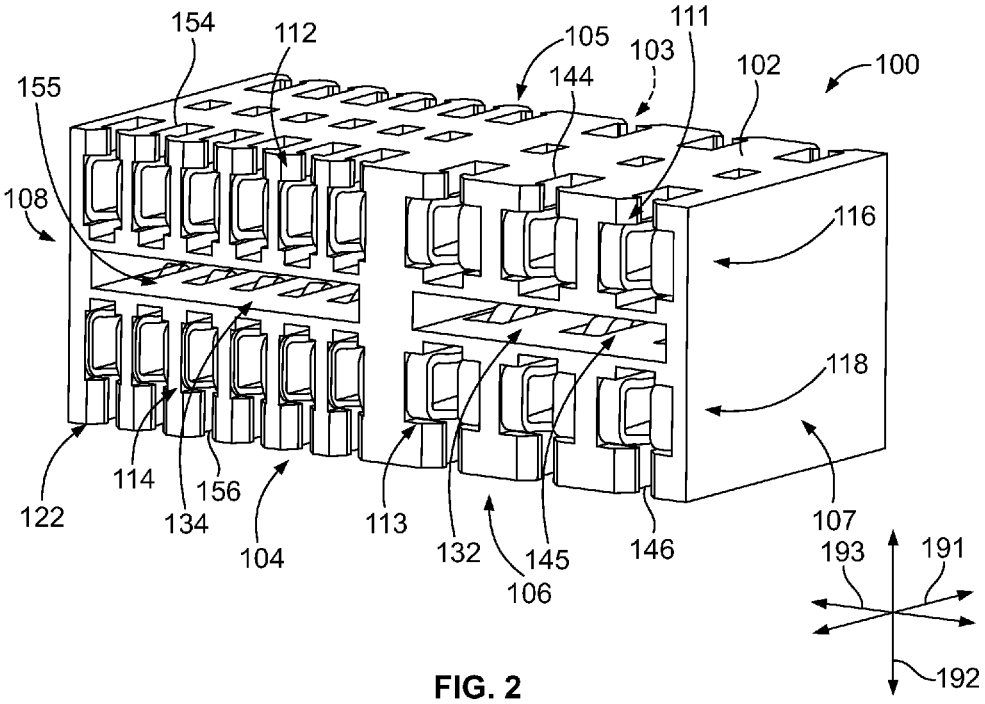
FIG. 2 is a rear-perspective view of the electrical connector of FIG. 1.

FIGS. 1 and 2 illustrate different perspective views of an electrical connector 100 formed in accordance with one embodiment. The electrical connector 100 is oriented with respect to mutually perpendicular axes 191-193, including a mating axis 191, a mounting axis 192, and a lateral axis 193. The electrical connector 100 includes a connector body or housing 102 having a plurality of body or housing sides 103-108, which include first and second engagement sides 103, 104, an elevation side 105, a mounting side 106, and end sides 107, 108. Also shown, the electrical connector 100 has electrical contacts 111-114 that are held by the connector body 102. The electrical contacts 111-114 extend through the connector body 102 such that each of the electrical contacts 111-114 is exposed and capable of electrically connecting to a component at each of the engagement sides 103, 104. The connector body 102 may be configured to hold other electrical contacts, such as the electrical contacts 500 (shown in FIG. 14) and 600 (shown in FIG. 16) described below.

In FIGS. 1 and 2, the electrical contacts 111-114 are arranged in a double-stack configuration in which a first contact row 116 includes the electrical contacts 111 and 112 and a second contact row 118 includes the electrical contacts 113 and 114. In the illustrated embodiment, the electrical contacts 111 and 113 are power contacts, and the electrical contacts 112 and 114 are signal contacts. The power contacts may be dimensioned larger than the signal contacts to carry a larger amount of current (e.g., greater than 10 A). It is noted, however, that FIGS. 1 and 2 illustrate only one arrangement of the electrical contacts 111-114 and various other configurations may be used. For instance, in other embodiments, the electrical connector 100 may have only a single-stack configuration with just one contact row. In other embodiments, the power and signal contacts may be distributed differently than as shown in FIGS. 1 and 2. In other embodiments, the electrical connector 100 may include only signal contacts or only power contacts.

As shown in FIGS. 1 and 2, the connector body 102 includes contact cavities 132, 134. The contact cavity 132 has the electrical contacts 111, 113 disposed therein, and the contact cavity 134 has the electrical contacts 112, 114 disposed therein. The contact cavities 132, 134 may extend through the connector body 102 between the engagement sides 103, 104 so that the electrical contacts 111-114 may extend through the connector body 102 and be exposed for directly engaging electrical components along the first and second engagement sides 103, 104.

The contact cavities 132, 134 may have component-receiving slots that are configured to receive a portion of a respective electrical component. Examples of such component-receiving slots may include a wire-receiving slot that receives a wire conductor or a board-receiving slot that receives a circuit board. For example, in FIG. 1, the contact cavity 132 includes multiple wire-receiving slots 141 and multiple wire-receiving slots 143 along the engagement side 103. The contact cavity 132 also includes a board-receiving slot 142 positioned between the wire-receiving slots 141, 143 along the engagement side 103. In FIG. 2, the contact cavity 132 includes wire-receiving slots 144, 146 and a board-receiving slot 145 positioned between the wire-receiving slots 144, 146. Similarly, in FIG. 1, the contact cavity 134 includes wire-receiving slots 151, 153 and a board-receiving slot 152 positioned between the wire-receiving slots 151, 153. In FIG. 2, the contact cavity 134 includes wire-receiving slots 154, 156 and a board-receiving slot 155 positioned between the wire-receiving slots 154, 156.

The electrical connector 100 has a first connector interface 120 (shown in FIG. 1) and a second connector interface 122 (shown in FIG. 2). In the illustrated embodiment, the connector interfaces 120, 122 include the engagement sides 103, 104, respectively. The connector interface 120 may also include portions of the electrical contacts 111-114 and portions of the surfaces that define the contact cavities 132, 134 along the engagement side 103 (e.g., the wire-receiving slots 141, 143, 151, 153 and the board-receiving slots 142, 152). The connector interface 122 may also include portions of the electrical contacts 111-114 and portions of the surfaces that define the contact cavities 132, 134 along the engagement side 104 (e.g., the wire-receiving slots 144, 146, 154, 156 and the board-receiving slots 145, 155). During a mating operation, the surfaces of the engagement sides 103, 104 and/or the surfaces that define the contact cavities 132, 134 may directly engage respective electrical components. In some embodiments, each of the connector interfaces 120, 122 is capable of mating with more than one type of electrical component at different times. In particular embodiments, at least one of the connector interfaces 120, 122 is capable of mating with more than one type of electrical component at the same time.

It is understood that FIGS. 1 and 2 illustrate just one configuration of an electrical connector that is supported by the description set forth herein. For instance, although the illustrated embodiment shows the connector interfaces 120, 122 facing in opposite directions along the mating axis 191, the connector interfaces 120, 122 may face in other directions. For example, the connector interfaces 120, 122 may face in perpendicular directions. In such embodiments, the electrical contacts 111-114 would be shaped to extend suitably between the connector interfaces 120, 122. As another example, the connector interfaces 120, 122 may face in a common direction (i.e., the same direction). In such embodiments, the electrical contacts 111-114 may be shaped to extend into the connector body 102 from the engagement side 103, then along the lateral axis 193, and then back to the engagement side 103.

Figure 3:
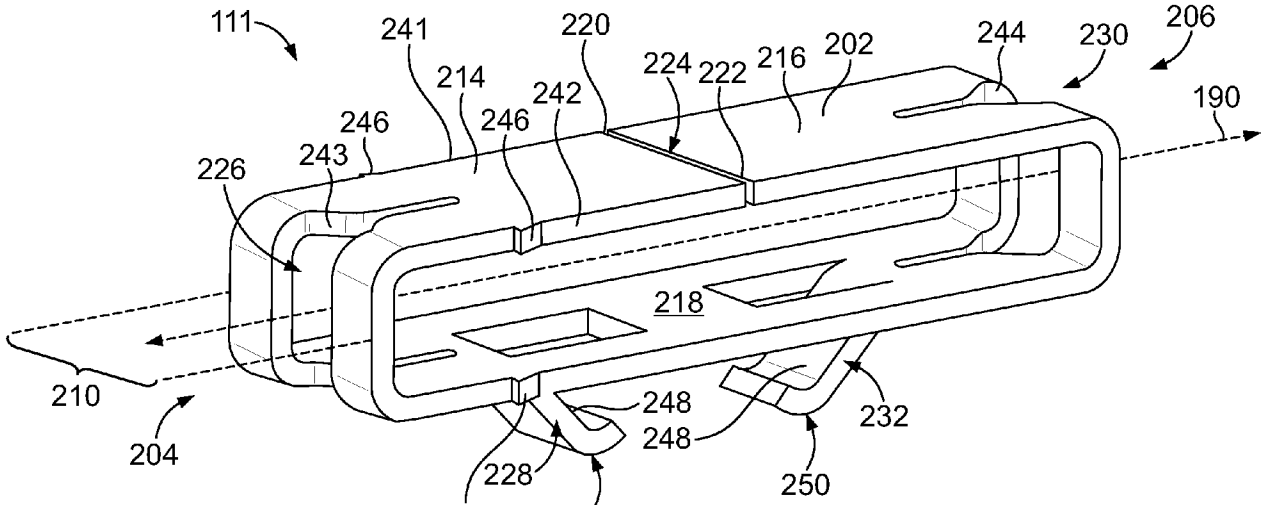
FIG. 3 is an isolated perspective view of an electrical contact that may be used by the electrical connector of FIG. 1 in accordance with one embodiment.
Figure 4:
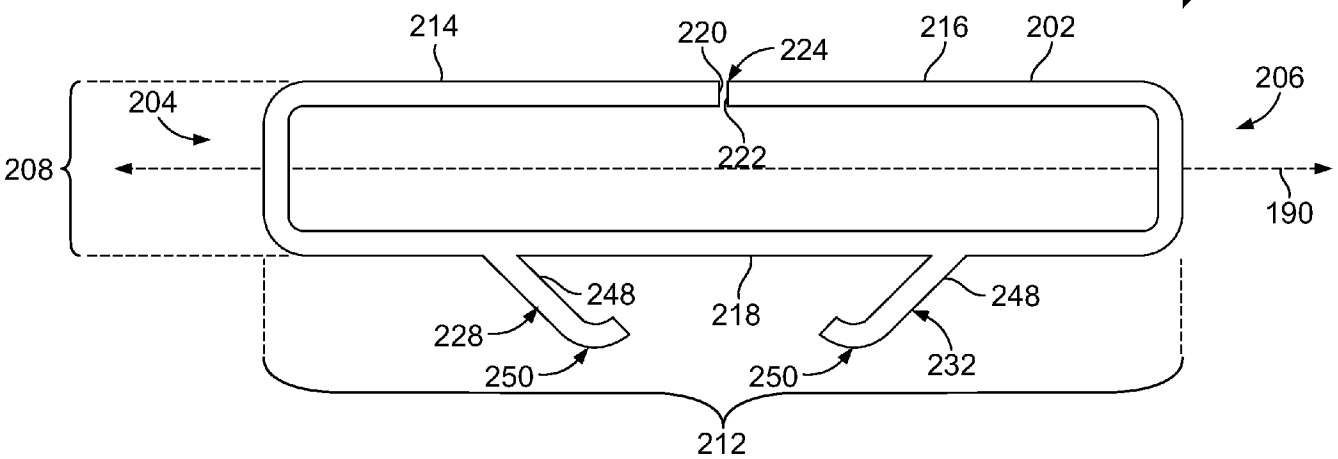
FIG. 4 is a side view of the electrical contact of FIG. 3.

FIGS. 3 and 4 show isolated perspective and side views, respectively, of the electrical contact 111 in accordance with one embodiment. Although the following description is with reference to the electrical contact 111, the description may be similarly applied to the electrical contacts 112-114. In some embodiments, the electrical contacts 113 have identical dimensions to the electrical contacts 111. In an exemplary embodiment, the electrical contacts 112, 114 have different dimensions than the electrical contacts 111, 113. For example, each of the electrical contacts 111-114 may be stamped and formed from conductive sheet material (e.g., sheet metal). The electrical contacts 111, 113, however, may be stamped from sheet material that has a greater thickness than the sheet material from which the electrical contacts 112, 114 are stamped. In the illustrated embodiment, the electrical contacts 111-114 are shaped to have similar features (e.g., spring members, IDC channels, etc.). However, in other embodiments, the electrical contacts may have different features.

As shown in FIGS. 3 and 4, the electrical contact 111 includes an elongated contact body 202. In some embodiments, the contact body 202 may be a single, continuous element. For example, the contact body 202 may be stamped and formed from sheet material. Alternatively, the contact body 202 may be machined form a single piece of material or molded from conductive material. In some embodiments, the contact body 202 may constitute an entirety of the electrical contact 111. However, in other embodiments, the electrical contact 111 may include added elements. For example, portions of the contact body 202 may be coated with another conductive material (e.g., tin or nickel coating) or an adhesive may be applied to the contact body 202.

The electrical contact 111 is oriented with respect to a central longitudinal axis 190 and extends between opposite contact ends 204, 206. In the illustrated embodiment, the longitudinal axis 190 extends parallel to the mating axis 191 (FIG. 1) when positioned within the connector body 102 (FIG. 1). After the contact body 202 is shaped, the contact body 202 has an operative height 208 (shown in FIG. 4), an operative width 210 (shown in FIG. 3), and an operative length 212 (shown in FIG. 4). The contact body 202 includes first and second engagement portions 214, 216 and a bridge portion 218 that joins the first and second engagement portions 214, 216.

The bridge portion 218 is located proximate to a center of the contact body 202 between the contact ends 204, 206. However, in other embodiments, the bridge portion 218 may be offset such that the bridge portion 218 is closer to the contact end 204 or closer to the contact end 206. The engagement portions 214, 216 are portions of the contact body 202 that are configured to mechanically and electrically engage at least one type of electrical component. As shown, the engagement portion 214 extends from the bridge portion 218 along the longitudinal axis 190 and is shaped (e.g., bent or folded) to extend along the height 208 and then back along the longitudinal axis 190 to a distal edge 220. Similarly, the engagement portion 216 extends from the bridge portion 218 along the longitudinal axis 190 and is shaped to extend along the height 208 and back along the longitudinal axis 190 to a distal edge 222. In the illustrated embodiment, the distal edges 220, 222 are proximate to and face each other with an edge seam 224 defined therebetween. In other embodiments, the distal edges 220, 222 may be separated by a greater distance and/or may not face each other.

In the illustrated embodiment, each of the engagement portions 214, 216 is configured to mechanically and electrically engage two types of electrical components. For example, the engagement portion 214 includes an insulation displacement contact (IDC) channel 226 (FIG. 3) and a spring member 228. The IDC channel 226 and the spring member 228 are located along the contact body 202 between the bridge portion 218 and the distal edge 220. The second engagement portion 216 includes an IDC channel 230 (FIG. 3) and a spring member 232 that are located along the contact body 202 between the bridge portion 218 and the distal edge 222. In particular embodiments, each of the IDC channels 226, 230 is configured to engage a respective wire conductor, such as the wire conductors described below in FIGS. 10-13, and each of the spring members 228, 232 is configured to engage a respective circuit board, such as the circuit boards described below in FIGS. 10-13.

As shown in FIG. 3, the contact body 202 has outer edges 241, 242 and inner edges 243, 244. In the illustrated embodiment, the outer and inner edges 241-244 are stamped edges. The inner edge 243 defines the IDC channel 226, and the inner edge 244 defines the IDC channel 230. In some embodiments, the inner edges 243, 244 (or portions thereof) may be shaped to facilitate cutting through the insulation of the insulated wires. For instance, the inner edges 243, 244 may be chamfered. The outer edges 241, 242 are sized and shaped relative to the portion of the contact cavity 132 (FIG. 1) that holds the electrical contact 111. More specifically, the outer edges 241, 242 may be configured to directly engage interior surfaces of the connector body 102 and form a frictional engagement therewith. To this end, the outer edges 241, 242 may include projections or grips 246 that directly engage the connector body 102.

In some embodiments, the contact body 202 may be stamped from sheet material. After the stamping operation, the contact body 202 may be a rectangular strip defined by the outer edges 241, 242 and having two openings defined by the inner edges 243, 244. At this time, the spring members 228, 232 may be stamped but not shaped to extend from the contact body 202. To shape the contact body 202, the spring members 228, 232 may be bent away from the bridge portion 218, and each of the engagement portions 214, 216 may be folded over so that the inner edges 243, 244 extend along the height 208. As such, the IDC channels 226, 230 may constitute a space that extends along the height 208 of the contact body 202.

As shown in FIGS. 3 and 4, when the contact body 202 is fully formed, the spring members 228, 232 may extend at respective acute angles with respect to the longitudinal axis 190 and/or the mating axis 191 (FIG. 1). Each of the spring members 228, 232 includes a contact beam 248 having a mating end 250 that is configured to directly engage an electrical component, such as a circuit board. In FIGS. 3 and 4, the spring members 228, 232 are in relaxed conditions. However, the spring members 228, 232 are capable of being deflected toward the bridge portion 218 or the longitudinal axis 190. When in a deflected condition, the spring members 228, 232 apply a biasing force away from the bridge portion 218 or the longitudinal axis 190 and against the object that has deflected the spring members 228, 232.

Figure 6:
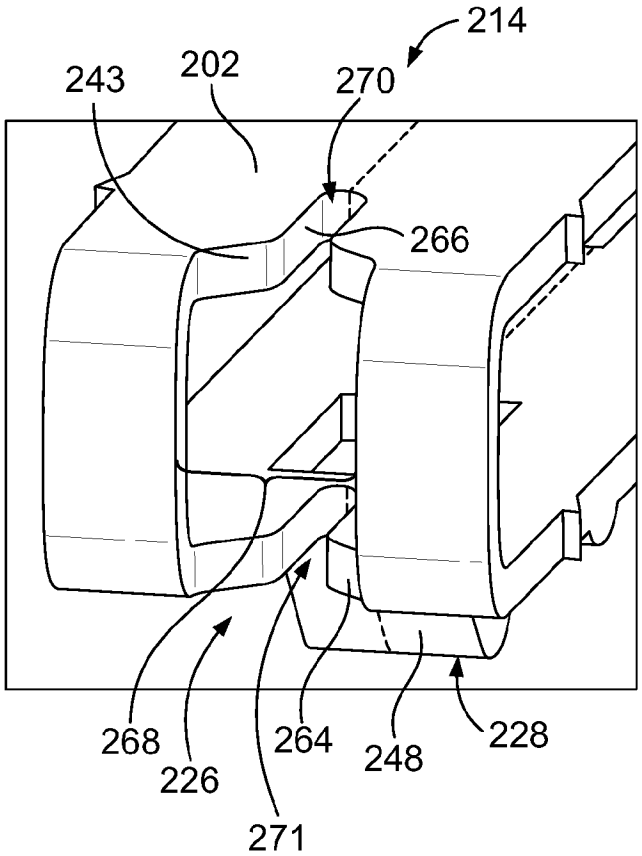
FIG. 6 is an enlarged perspective view of the engagement portion of the electrical contact of FIG. 3.
Figure 5:
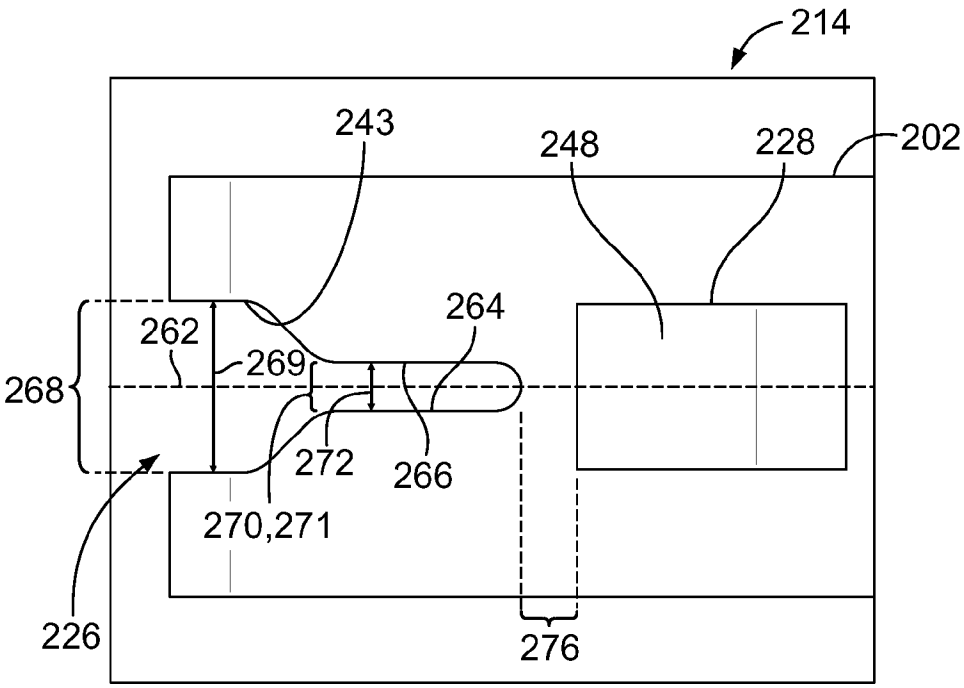
FIG. 5 is an enlarged plan view of an engagement portion of the electrical contact of FIG. 3.

FIGS. 5 and 6 illustrate a plan view and a perspective view of the engagement portion 214. Although the following is with specific reference to the engagement portion 214, the description may be similarly applied to the engagement portion 216 (FIG. 3). As shown in FIG. 5, a contact plane 262 is oriented to coincide with the longitudinal axis 190 (FIG. 3) and bisect the contact body 202. The dashed lines along the contact body 202 in FIG. 6 indicate where the contact plane 262 intersects the contact body 202.

The contact plane 262 may bifurcate the IDC channel 226 such that the inner edge 243 is divided into first and second edge portions 264, 266. The edge portions 264, 266 face each other and define the IDC channel 226 therebetween. In the illustrated embodiment, the edge portions 264, 266 are sized and shaped to define an insertion region 268 of the IDC channel 226 and contact regions 270, 271 of the IDC channel 226. The contact regions 270, 271 are stacked with respect to each other.

The insertion region 268 and the contact regions 270, 271 have respective widths 269, 272 (shown in FIG. 5). The width 269 of the insertion region 268 is greater than the width 272 of the contact regions 270, 271. More specifically, the insertion region 268 is dimensioned to receive an insulated wire, and each of the contact regions 270, 271 is dimensioned smaller to receive a wire conductor. During a mating operation, an insulated wire (or a wire conductor without insulation) may be oriented to extend lengthwise along the contact plane 262 through the insertion region 268. As the wire is inserted into the contact regions 270, 271, the edge portions 264, 266 may slice the insulation of the insulated wire, if the insulation is present, and directly engage the wire conductor therein.

In the illustrated embodiment, the contact body 202 is shaped such that the contact plane 262 extends through each of the IDC channel 226 and the spring member 228. As such, the IDC channel 226 and the spring member 228 are aligned along the contact plane 262. In particular embodiments, the contact plane 262 may also extend through each of the IDC channel 230 (FIG. 3) and the spring member 232 (FIG. 3). Also shown in FIGS. 5 and 6, the IDC channel 226 and the spring member 228 are positioned proximate to each other. For example, an end of the contact regions 270, 271 is separated by the contact beam 248 by a short distance 276 (shown in FIG. 5). In some embodiments, the short distance 276 may be substantially the minimal distance required to supply a sufficient amount of material to support the spring member 228 and provide the spring member 228 with the resilient properties discussed herein.

Figure 7:
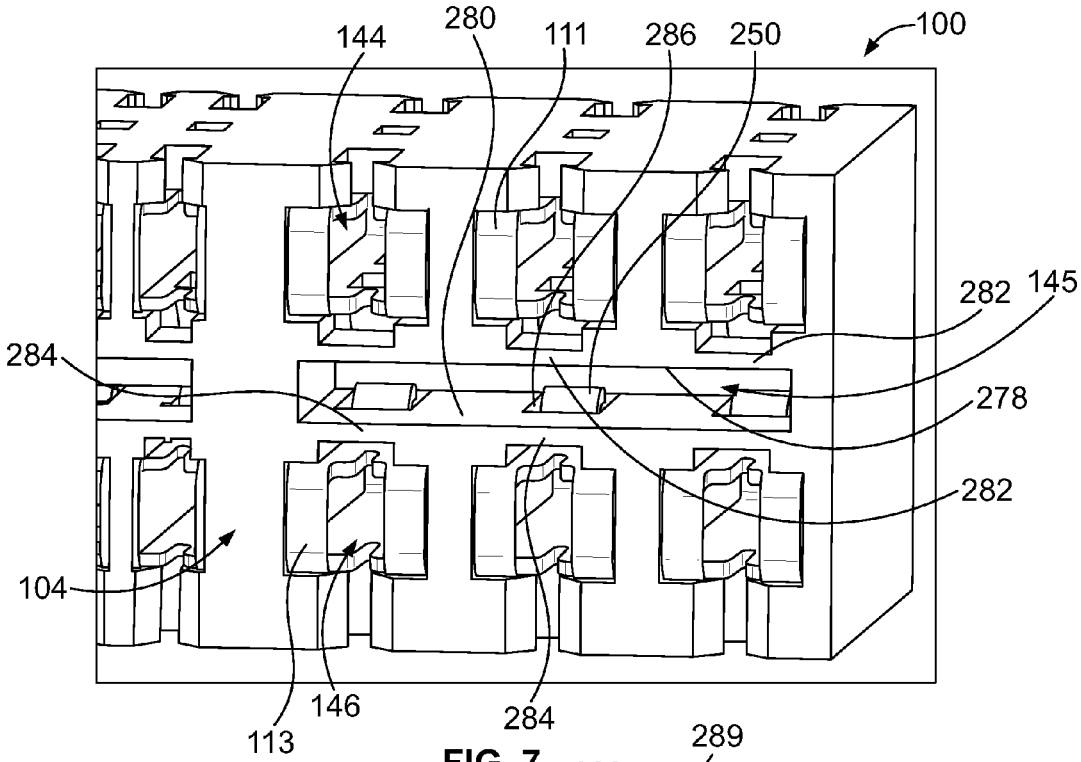
FIG. 7 is an enlarged rear-perspective view of the electrical connector of FIG. 1 illustrating component-receiving slots in accordance with one embodiment.

FIG. 7 is a perspective view of the electrical connector 100 showing the engagement side 104. More specifically, FIG. 7 shows the electrical contacts 111, 113 positioned within the wire-receiving slots 144, 146, respectively, and the board-receiving slot 145 extending between the wire-receiving slots 144, 146. In the illustrated embodiment, the electrical connector 100 includes three (3) wire-receiving slots 144, three (3) wire-receiving slots 146, and a single board-receiving slot 145, although other embodiments may include different numbers of component-receiving slots. As shown, the wire-receiving slots 144, 146 are partially defined by interior walls 278, 280, respectively. The interior walls 278, 280 have wire stops 282, 284, respectively. The wire stops 282, 284 are configured to prevent a wire conductor from advancing through the wire-receiving slots 144, 146, respectively, and into the board-receiving slot 145. However, as shown with respect to the interior wall 280, the interior walls may having member openings 286 that permit the mating ends 250 of the electrical contacts 111, 113 to project into the board-receiving slot 245.

In some embodiments, the interior walls 278, 280 or interior surfaces that define the board-receiving slot 145 may include board latches (not shown) that are configured to be removably coupled to the circuit board that is received by the board-receiving slot 145. By way of one example, the board latches may be dimensioned relative to recesses or holes extending through the circuit board. As the circuit board is inserted into the board-receiving slot 145, a latch located within the board-receiving slot 145 may engage the circuit board. In some instances, the board latch can be deflected by the circuit board thereby permitting the circuit board to be further advanced into the board-receiving slot 145. When the board latch clears a recess of the circuit board, the board latch may flex into the recess thereby gripping the circuit board. In addition to or as an alternative to the board latch, the interior walls 278, 280 and other interior surfaces of the slot may frictionally engage and hold the circuit board.

Figure 8:
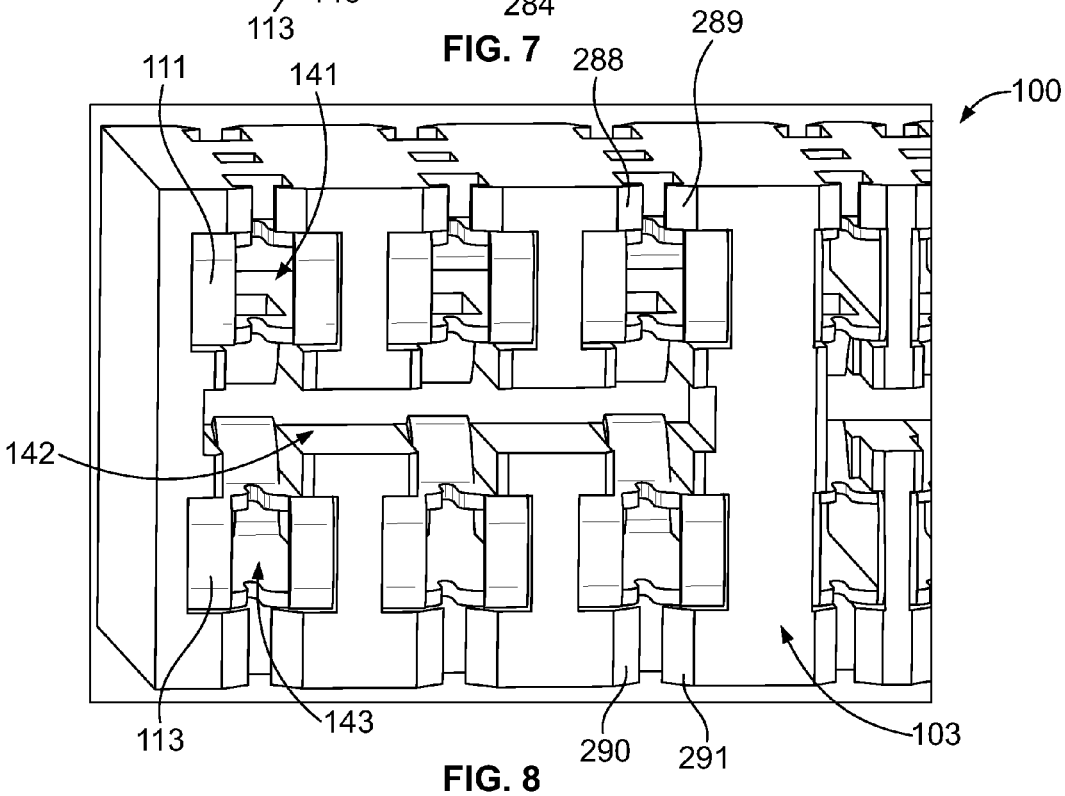
FIG. 8 is an enlarged front-perspective view of the electrical connector of FIG. 1 illustrating component-receiving slots in accordance with one embodiment.

FIG. 8 is a perspective view of the electrical connector 100 showing the engagement side 103. More specifically, FIG. 8 shows the electrical contacts 111, 113 disposed within the wire-receiving slots 141, 143, respectively, and the board-receiving slot 142 extending between the wire-receiving slots 141, 143. Unlike the engagement side 104, the engagement side 103 does not include wire stops. As such, a single wire conductor is permitted, if desired, to be advanced entirely through one of the wire-receiving slots 141, through the board-receiving slot 142, and into the wire-receiving slot 143 or in an opposite direction through the wire-receiving slot 143 to the wire-receiving slot 141.

Also shown, the wire-receiving slots 141 may include gate arms or fingers 288, 289, and the wire-receiving slots 143 may include gate arms or fingers 290, 291. The gate arms 288-291 are configured to permit a wire conductor to be inserted into the wire-receiving slots 141, 143 but to prevent inadvertent removal of the wire conductor. For example, a single wire conductor may be oriented to extend along forward-facing surfaces of the gate arms 288-291. In this orientation, the wire conductor would extend parallel to the mounting axis 192 (FIG. 1). The length of the wire conductor may then be urged in a mating direction along the mating axis 191 (FIG. 1) past the gate arms 288-291 into the respective wire-receiving slot 141, 143. The gate arms 288-291 may be configured to deflect inwardly when engaged by the wire conductor and permit the wire conductor to be inserted therein.

Figure 9:
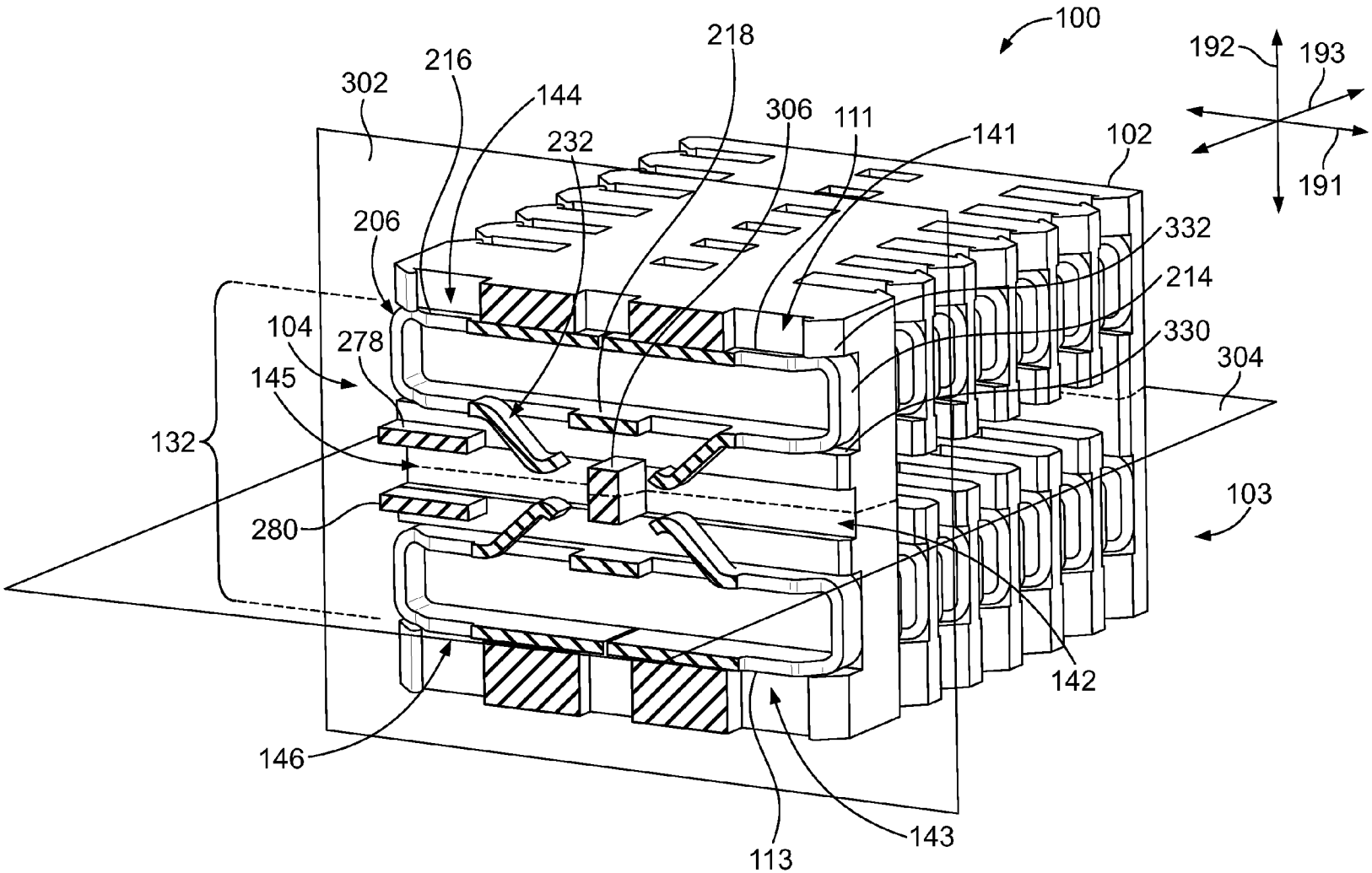
FIG. 9 illustrates a cross-section of the electrical connector of FIG. 1 showing the component-receiving slots in greater detail.

FIG. 9 is a perspective cross-section of the electrical connector 100 illustrating the component-receiving slots (e.g., the wire-receiving and board-receiving slots) in greater detail. The cross-section of the electrical connector 100 in FIG. 9 is taken along a wire (or first) plane 302. The wire plane 302 may be parallel to or coincide with the contact plane 262 in FIG. 5. A board (or second) plane 304 is also shown in FIG. 9 that intersects the connector body 102 (as indicated by dashed lines) and is oriented orthogonal to the wire plane 302. In the illustrated embodiment, the wire plane 302 is parallel to a plane defined by the mating and mounting axes 191, 192, and the board plane 304 is parallel to a plane defined by the mating and lateral axes 191, 193.

As shown, the contact cavity 132 includes the wire-receiving slots 141, 143 along the engagement side 103 and the wire-receiving slots 144, 146 along the engagement side 104. The contact cavity 132 also includes the board-receiving slots 142, 145. In the illustrated embodiment, the wire-receiving slots 141, 143, 144, 146, and the board-receiving slots 142, 145 are in fluid communication with one another through internal passages thereby forming the contact cavity 132. In other embodiments, however, one or more of the component-receiving slots may not be in fluid communication with one or more of the other component-receiving slots.

As shown, the connector body 102 may include an internal backstop 306. The wire plane 302 extends through the internal backstop 306 in FIG. 9 as indicated by hatching and the board plane 304 intersects the backstop 306 as indicated by the dashed lines. The internal backstop 306 may be positioned between and separate the board-receiving slots 142, 145. The internal backstop 306 may function as a positive stop that engages and prevents the circuit boards from moving further into the connector body 102 along the mating axis 191. The interior walls 278, 280 are also shown in FIG. 9 along the engagement side 104.

To insert the electrical contacts 111, the contact ends 206 may be initially inserted into corresponding wire-receiving slots 141 and advanced into the contact cavity 132 in a direction along the mating axis 191 from the engagement side 103 to the engagement side 104. As the electrical contact 111 is moved along the mating axis 191, the spring member 232 engages the internal backstop 306 and is deflected toward the bridge portion 218 of the electrical contact 111. When the spring member 232 clears the internal backstop 306, the spring member 232 may resiliently flex back into the relaxed condition as is shown in FIG. 9. When held by the connector body 102, the electrical contact 111 may engage ledge surfaces 330, 332 that partially define the wire-receiving slots 141. In the illustrated embodiment, the ledge surfaces 330, 332 extend entirely through the connector body 102 between the engagement sides 103, 104. In other embodiments, one or more ledge surfaces may be positioned proximate to the engagement side 103 and one or more ledge surfaces may be positioned proximate to the engagement side 104.

The electrical contacts 113 may be positioned within the connector body 102 in a similar manner. However, as shown in FIG. 9, the electrical contacts 113 may be inverted with respect to the electrical contacts 111 so that the spring members of the electrical contacts 111, 113 may engage a common circuit board. Accordingly, the electrical contacts 111, 113 may be disposed within the contact cavity 132 and held by the connector body 102 such that the first and second engagement portions 214, 216 are positioned proximate to the first and second engagement sides 103, 104, respectively.

In the illustrated embodiment, the wire plane 302 extends through vertical spaces defined by the wire-receiving slots 141, 143, 144, 146. The wire conductor(s) may extend along and coincide with the wire plane 302 when disposed within one or more of the wire-receiving slots 141, 143, 144, 146. As shown, the board plane 304 is orthogonal to the wire plane 302 and extends through horizontal spaces defined by the board-receiving slots 142, 145.

In some embodiments, a wire loader (not shown) may be used to load the wire conductors into the wire-receiving slots 141, 143, 144, 146. By way of example, the wire loader may have a dielectric block or body with a loading face that is configured to oppose the engagement side 103 with the wire conductors therebetween. The wire conductors may be positioned for insertion into the wire-receiving slots 141, 143. More specifically, a wire conductor may be positioned to extend along and engage the corresponding gate arms 288, 289 (FIG. 8) of the wire-receiving slot that will receive the wire conductor. In some cases, a single wire conductor may extend along the gate arms 288, 289 of a wire-receiving slot 141 and also along the gate arms 290, 291 (FIG. 8) of the wire-receiving slot 143 that is aligned with the wire-receiving slot 141 along the wire plane 302. The loading face of the wire loader may have insertion walls (not shown) that are dimensioned to engage the wire conductors along, for example, a length of the wire conductors. The insertion walls may project toward the engagement side 103. The insertion walls may have a width that is approximately equal to the size of the gap that separates the gate arms 288, 289 and the gate arms 290, 291. To inset the wire conductors, the wire loader may be pressed into the engagement side 103 such that the insertion walls push the wire conductors past the corresponding gate arms and into the contact regions 270, 271 (FIG. 6) of the IDC channel 226. In some cases, the wire loader may remain engaged to the mating interface 120 after the wire conductors are loaded. In other words, the wire loader may remain attached to the electrical connector 100 during operation.

It is noted that the above description of the wire loader only describes one example. Other types of wire loaders and wire loaders with different features may be used to load the wire conductors. For example, the insertion walls may not extend along the wire plane 302 and be inserted into the wire-receiving slots 141, 143. Instead, the insertion walls may extend along the board plane 304 and engage the wire conductors above the wire-receiving slot 141, below the wire-receiving slot 143, and at the board-receiving slot 145. In other words, when the wire conductors are loaded, a first insertion wall may slide along the elevation side 105, a second insertion wall may slide along the mounting side 106, and a third insertion wall may slide through the board-receiving slot 145.

Figure 10:
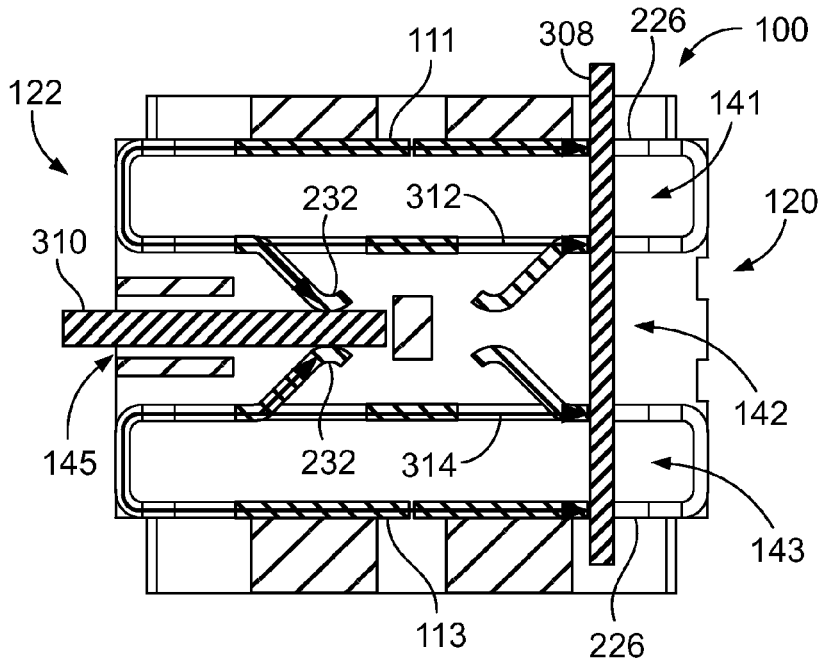
FIG. 10 is a cross-section of the electrical connector of FIG. 1 forming a printed circuit board (PCB) to insulation displacement contact (IDC) interconnection (or PCB-IDC interconnection) in accordance with one embodiment.

FIGS. 10-13 illustrate the cross-section of FIG. 9 in which the wire plane 302 (FIG. 9) coincides with the face of the page in FIGS. 10-13. FIGS. 10-13 illustrate various interconnections that may be formed by the electrical connector 100 by the first and second connector interfaces 120, 122. For example, as shown in FIG. 10, the electrical connector 100 may be used to form a PCB-IDC interconnection. More specifically, FIG. 10 shows a wire conductor 308, which may or may not have insulation while engaged to the electrical connector 100. The wire conductor 308 is oriented to extend along the mounting axis 192 (FIG. 1) and substantially coincide with the wire plane 302 (FIG. 9) and/or the contact plane 262 (FIG. 5). In the illustrated embodiment, the wire conductor 308 is permitted to extend entirely through the wire-receiving slot 141 and the board-receiving slot 142 and into the wire-receiving slot 143. The wire conductor 308 directly engages each of the IDC channels 226 of the electrical contacts 111, 113.

Also shown in FIG. 10, a circuit board (or PCB) 310 is received within the board-receiving slot 145 and directly engages the spring members 232 of the electrical contacts 111, 113. With each of the circuit board 310 and the wire conductor 308 engaged to the electrical contacts 111, 113, the electrical connector 100 establishes transmission pathways 312, 314. Transmission may occur in either direction along the transmission pathways 312, 314, although the direction will be the same for each transmission pathway 312, 314 during operation (i.e., either from the wire conductor 308 to the circuit board 310 or in an opposite direction).

Figure 11:
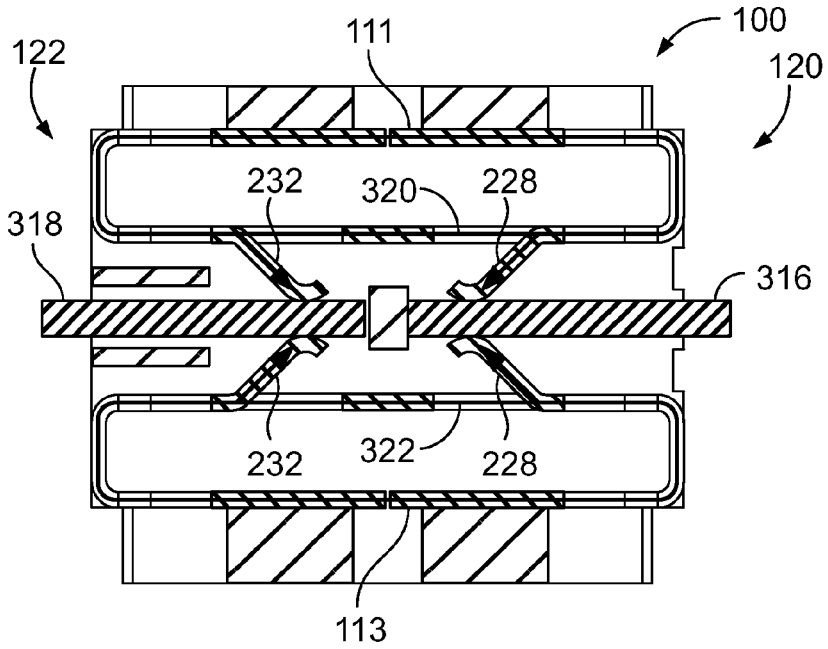
FIG. 11 is a cross-section of the electrical connector of FIG. 1 forming a PCB-PCB interconnection in accordance with one embodiment.

In FIG. 11, the electrical connector 100 is used to establish a PCB-PCB interconnection. As shown, circuit boards 316, 318 have been inserted into the board-receiving slots 142, 145, respectively. As such, the spring members 232 of the electrical contacts 111, 113 each engage the circuit board 318, and the spring members 228 of the electrical contacts 111, 113 each engage the circuit board 316. Transmission pathways 320, 322 exist through the PCB-PCB interconnection.

Figure 12:
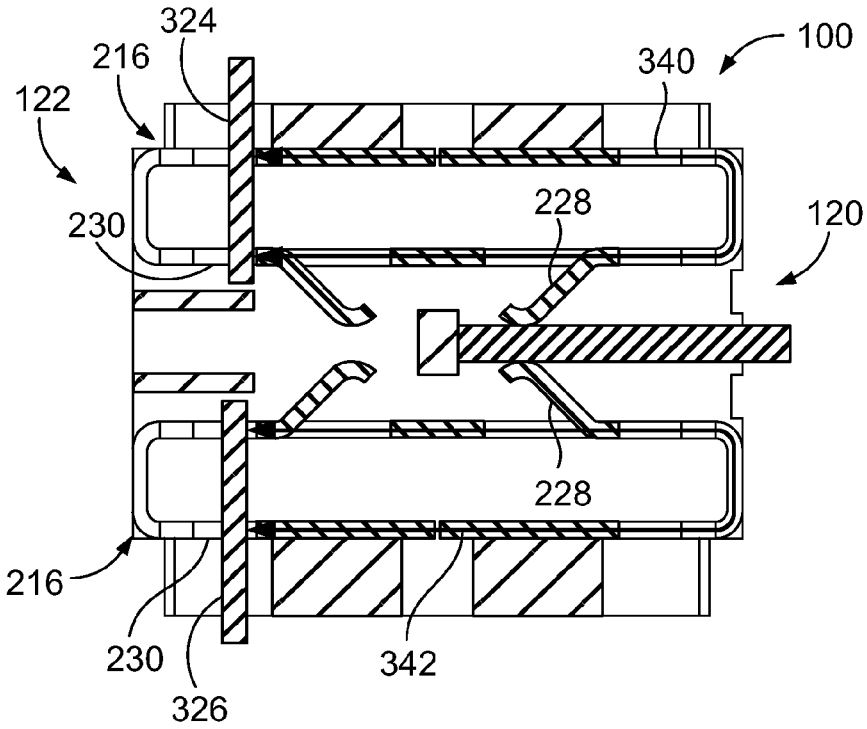
FIG. 12 is a cross-section of the electrical connector of FIG. 1 forming a multiple IDC-PCB interconnection in accordance with one embodiment.

FIG. 12 illustrates a dual-IDC-PCB interconnection. As shown, wire conductors 324, 326 are coupled to the engagement portions 216 of the electrical contacts 111, 113 respectively, through the IDC channels 230 and a circuit board 328 is engaged to each of the electrical contacts 111, 113 through the spring members 228. Accordingly, two different wire conductors are engaged to the second connector interface 122 that are, in turn, each communicatively coupled to the first connector interface 120 of the electrical connector 100 through transmission pathways 340, 342.

Figure 13:
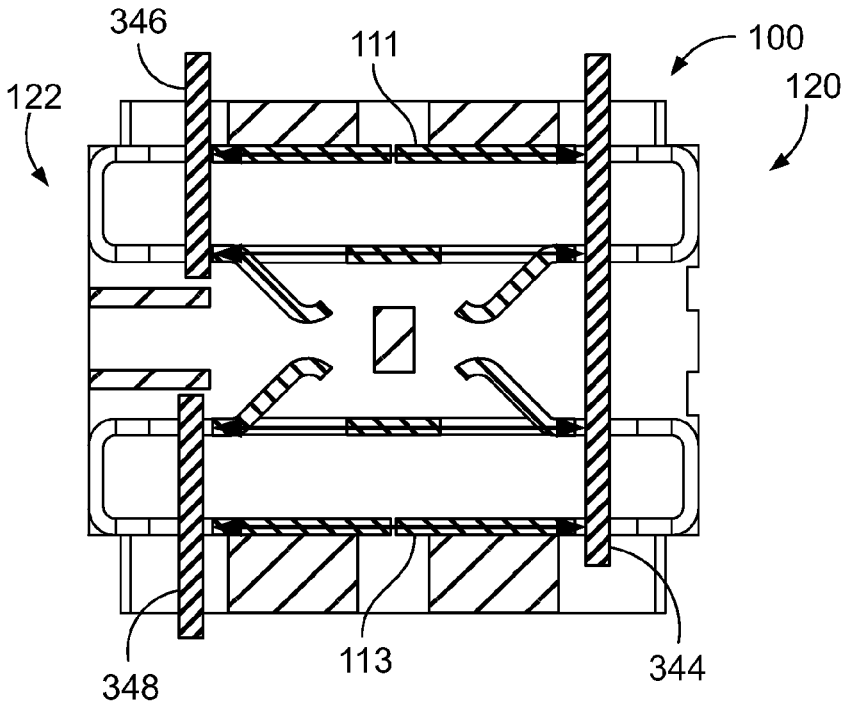
FIG. 13 is a cross-section of the electrical connector of FIG. 1 forming a multiple IDC-IDC interconnection in accordance with one embodiment.

FIG. 13 illustrates a dual-IDC-IDC interconnection in which the electrical contacts 111, 113 are each engaged to a common wire conductor 344 along the first connector interface 120. However, the electrical contacts 111, 113 are engaged to different wire conductors 346, 348 along the second connector interface 122.

Figure 14:
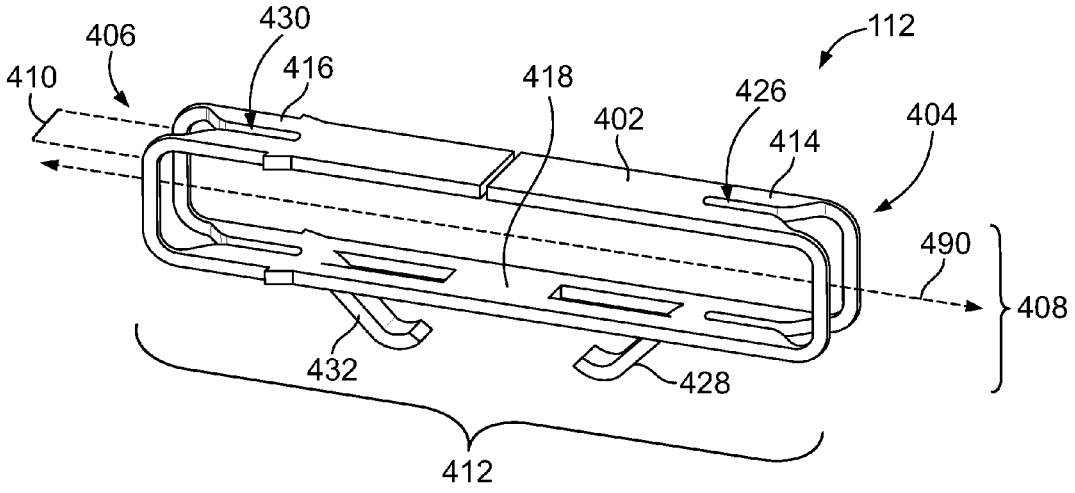
FIG. 14 is an isolated perspective view of an electrical contact formed in accordance with one embodiment.

FIG. 14 is an isolated perspective view of one of the electrical contacts 112. As described herein, the electrical contacts 112 may be signal contacts that are similarly shaped as the electrical contacts 111, 113 but may have smaller dimensions in some embodiments. For example, the electrical contact 112 is oriented with respect to a central longitudinal axis 490 and extends between opposite contact ends 404, 406. In the illustrated embodiment, the longitudinal axis 490 extends parallel to the mating axis 191 (FIG. 1) when positioned within the connector body 102 (FIG. 1). The electrical contact 112 includes a contact body 402 that has an operative height 408, an operative width 410, and an operative length 412. In some embodiments, the height 408 and the length 412 may be substantially equal to the height 208 and the length 212, respectively, of the contact body 202. In the illustrated embodiment, the width 410 is less than the width 210 of the contact body 202.

The contact body 402 includes first and second engagement portions 414, 416 and a bridge portion 418 that joins the first and second engagement portions 414, 416. The bridge portion 418 is located proximate to a center of the contact body 402 between the contact ends 404, 406. The engagement portions 414, 416 are portions of the contact body 402 that are configured to mechanically and electrically engage at least one type of electrical component. For example, the engagement portion 414 includes an IDC channel 426 and a spring member 428, and the engagement portion 416 includes an IDC channel 430 and a spring member 432.

Figure 15:
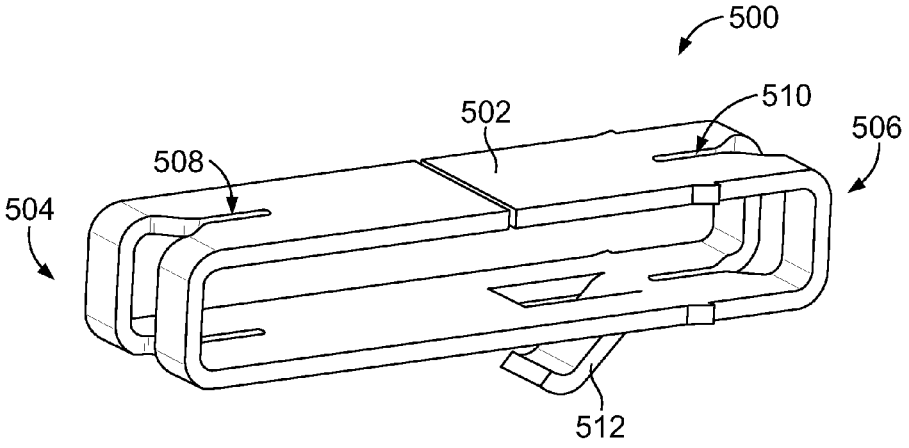
FIG. 15 is an isolated perspective view of an electrical contact formed in accordance with one embodiment.

FIG. 15 is an isolated perspective view of an electrical contact 500 formed in accordance with one embodiment. The electrical contact 500 is similar to the electrical contacts 111-114 and has a dual-IDC configuration. However, unlike the electrical contacts 111-114, the electrical contact 500 does not have a dual spring member configuration. More specifically, the electrical contact 500 has a contact body 202 that extend between opposite contact ends 504, 506. The electrical contact 500 includes IDC channels 508, 510 at the contact ends 504, 506, respectively. However, the electrical contact 500 only includes a single spring member 512 that is proximate to the IDC channel 510.

Figure 16:
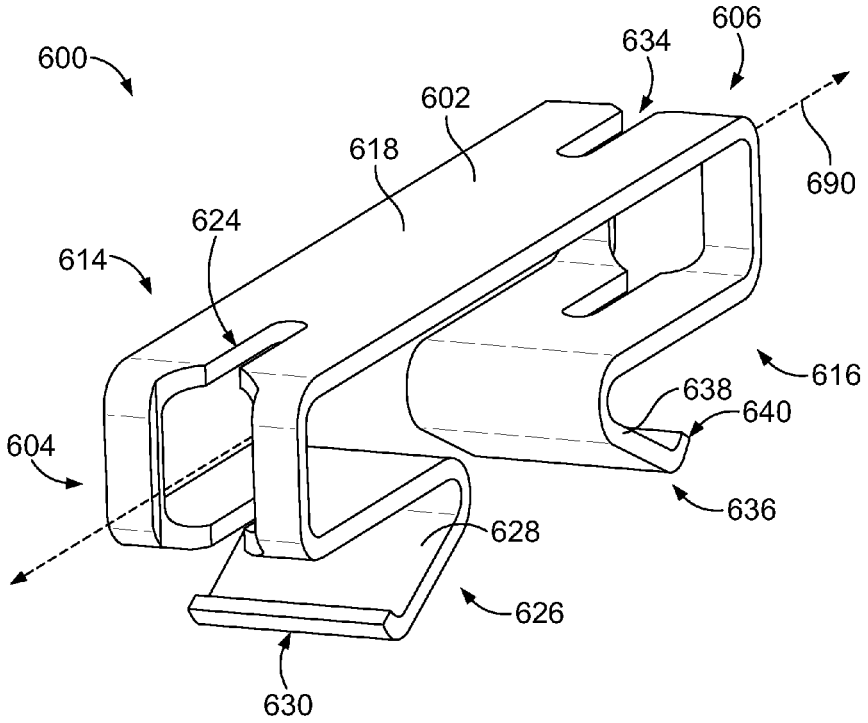
FIG. 16 is an isolated perspective view of an electrical contact formed in accordance with one embodiment.
Figure 17:
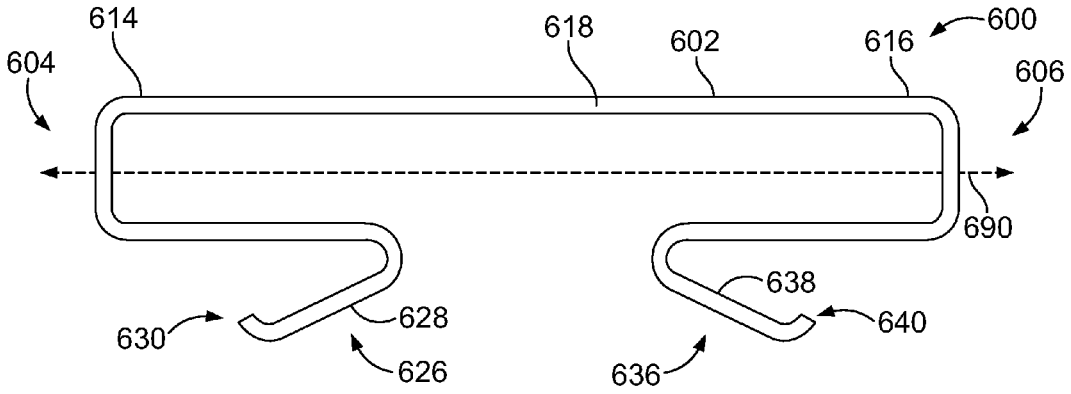
FIG. 17 is a side view of the electrical contact of FIG. 16.

FIGS. 16 and 17 show isolated perspective and side views, respectively, of an electrical contact 600. The electrical contact 600 may have similar features as the other electrical contacts described herein, such as the electrical contacts 111, 112, and 500. The electrical contact 600 includes a contact body 602. In some embodiments, the contact body 602 may be a single, continuous element. For example, the contact body 602 may be stamped and formed from sheet material. Alternatively, the contact body 602 may be machined to form a single piece of material or molded from conductive material. In some embodiments, the contact body 602 may constitute an entirety of the electrical contact 600. However, in other embodiments, the electrical contact 600 may include added elements. For example, portions of the contact body 602 may be coated with another conductive material (e.g., tin or nickel coating) or an adhesive may be applied to the contact body 602.

The electrical contact 600 is oriented with respect to a central longitudinal axis 690 and extends between opposite contact ends 604, 606. The contact body 602 includes first and second engagement portions 614, 616 and a bridge portion 618 that joins the first and second engagement portions 614, 616. The bridge portion 618 is located proximate to a center of the contact body 602 between the contact ends 604, 606. For example, in the illustrated embodiment, the contact body 602 is an elongated rectangular strip. The bridge portion 618 may include a center of the elongated strip.

The engagement portions 614, 616 are portions of the contact body 602 that are configured to mechanically and electrically engage at least one type of electrical component. In the illustrated embodiment, each of the engagement portions 614, 616 is configured to mechanically and electrically engage two types of electrical components. For example, the engagement portion 614 includes an IDC channel 624 (FIG. 16) and a spring member 626. The spring member 626 includes a contact beam 628 having a mating end 630. The engagement portion 616 includes an IDC channel 634 (FIG.

16) and a spring member 636. The spring member 636 includes a contact beam 638 having a mating end 640. Each of the IDC channels 624, 634 may be configured to engage a respective wire conductor, such as the wire conductors described with respect to FIGS. 10-13, and each of the spring members 626, 636 is configured to engage a respective circuit board, such as the circuit boards described with respect to FIGS. 10-13. In some embodiments, a width of the spring member 626 and/or the spring member 636 may be configured to provide a designated biasing force. For example, the width may be decreased as that shown in FIGS. 16 and 17.

Similar to the contact body 202 (FIG. 3), the contact body 602 may be sized and shaped relative to a contact cavity (not shown) in which the contact body 602 will be disposed. For example, the contact body 602 or the electrical contact 600 may be sized and shaped to be inserted into the contact cavity 132 (FIG. 1). In some embodiments, edges that define the contact body 602 may be configured to directly engage interior surfaces of the connector body 102 (FIG. 1) and form a frictional engagement therewith.

As shown in FIGS. 16 and 17, when the contact body 602 is fully formed, the spring members 626, 636 may extend at respective acute angles with respect to the longitudinal axis 690. The spring members 626, 636 are in relaxed conditions. However, the spring members 626, 636 are capable of being deflected toward the bridge portion 618 or the longitudinal axis 690. When in a deflected condition, the spring members 626, 636 provide a biasing force away from the bridge portion 618 or the longitudinal axis 690 and against the object that has deflected the spring members 626, 636.

Unlike the contact body 202 in which the spring members 228, 232 are defined from a portion of the contact body 202 proximate to the bridge portion 218 (FIG. 3), the spring members 626, 636 may be formed from opposite ends of the contact body 602. For example, the IDC channels 226, 230 are located between the spring members 228, 232 and the distal edges 220, 222 as shown in FIG. 3. On the other hand, the mating ends 630, 640 may represent the distal edges of the contact body 602.

Figure 18:
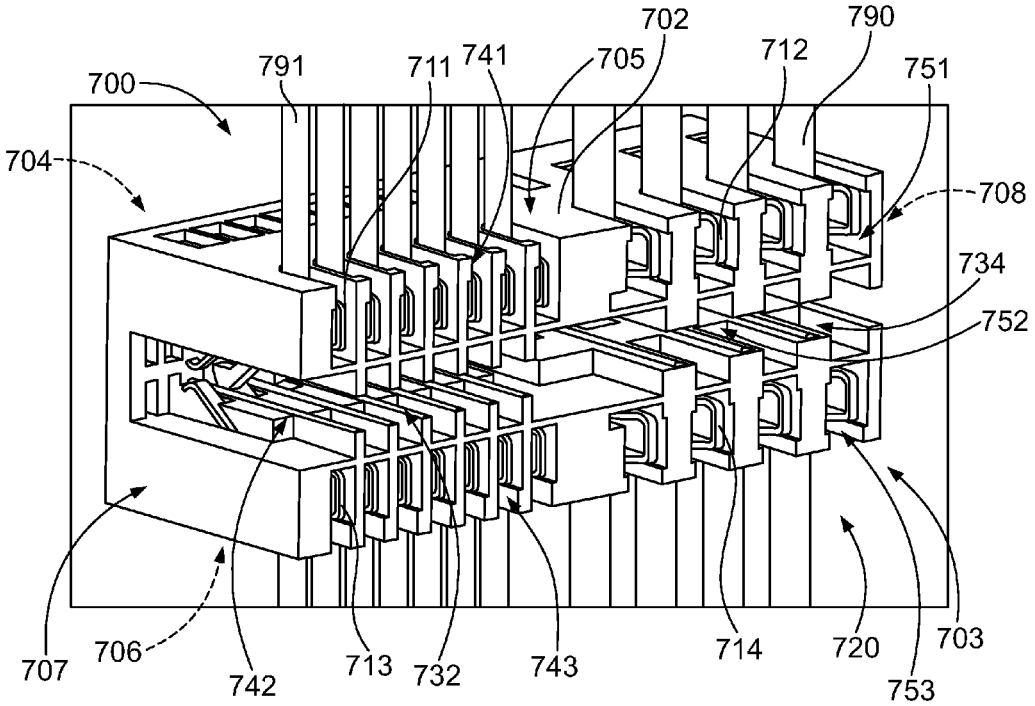
FIG. 18 is a front-perspective view of an electrical connector formed in accordance with one embodiment.

FIG. 18 is a front-perspective view of an electrical connector 700 formed in accordance with one embodiment. The electrical connector 700 may have similar features as the electrical connector 100 (FIG. 1). Likewise, the electrical connector 100 may be configured to have similar features as the electrical connector 700. The electrical connector 700 includes a connector body or housing 702 having a plurality of body or housing sides 703-708, which include an engagement sides 703, a non-engagement or back side 704, an elevation side 705, a mounting side 706, and end sides 707, 708. Also shown, the electrical connector 700 has electrical contacts 711-714 that are held by the connector body 702. The electrical contacts 711-714 are exposed along the engagement side 703 and are capable of electrically connecting to one or more components.

In the illustrated embodiment, the electrical contacts 711 and 713 are signal contacts, and the electrical contacts 712 and 714 are power contacts. The power contacts may be dimensioned larger than the signal contacts to carry a larger amount of current (e.g., greater than 10 A). Also shown, the connector body 702 includes contact cavities 732, 734. The contact cavity 732 has the electrical contacts 711, 713 disposed therein, and the contact cavity 734 has the electrical contacts 712, 714 disposed therein.

The electrical connector 700 may have multiple component-receiving slots along the engagement side 703. For instance, the contact cavity 732 includes multiple wire-receiving slots 741 and multiple wire-receiving slots 743 along the engagement side 703. The contact cavity 732 also includes a board-receiving slot 742 positioned between the wire-receiving slots 741, 743 along the engagement side 703. Similarly, the contact cavity 734 includes wire-receiving slots 751, 753 and a board-receiving slot 752 positioned between the wire-receiving slots 751, 753. In the illustrated embodiment, the board-receiving slots 742, 752 are in fluid communication with one another through the connector body 702. Each of the board-receiving slots 742, 752 may receive a separate circuit board or the board-receiving slots 742, 752 may receive a common circuit board that extends across an entire width of the connector body 702.

The electrical connector 700 has a connector interface 720. In the illustrated embodiment, the connector interface 720 includes the engagement side 703 of the connector body 702, portions of the electrical contacts 711-714, and portions of the surfaces that define the contact cavities 732, 734 along the engagement side 703 (e.g., the wire-receiving slots 741, 743 and the board-receiving slots 742, 752). During a mating operation, the surfaces of the engagement side 703 and/or the surfaces that define the contact cavities 732, 734 may directly engage respective electrical components. The connector interface 720 may be capable of mating with more than one type of electrical component, such as wire conductors 790, 791 and/or a circuit board (not shown), at different times or simultaneously.

Figure 19:
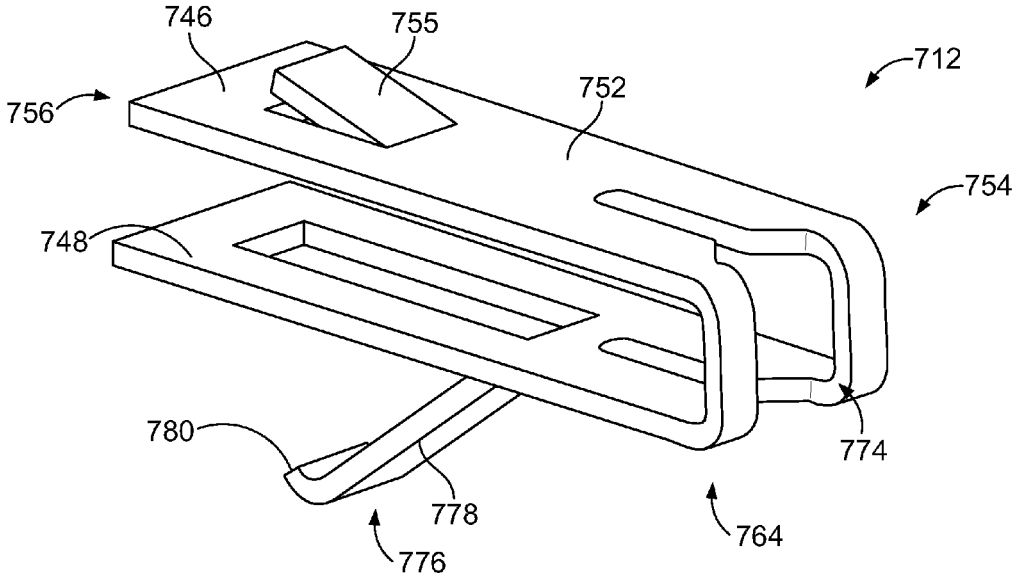
FIG. 19 is an isolated perspective view of an electrical contact formed in accordance with one embodiment that may be used with the electrical connector of FIG. 18.

FIG. 19 is an isolated perspective view of the electrical contact 712. The electrical contact 712 is a power contact. In some embodiments, the electrical contacts 711, 713 may have a similar shape as the electrical contact 712, but with smaller dimensions. The electrical contact 712 may have similar features as the other electrical contacts described herein, such as the electrical contacts 111, 112, 500, and 600, which may also be modified to include similar features as the electrical contact 712. The electrical contact 712 includes a contact body 752. In some embodiments, the contact body 752 may be a single, continuous element. For example, the contact body 752 may be stamped and formed from sheet material. Alternatively, the contact body 752 may be machined to form a single piece of material or molded from conductive material.

The electrical contact 712 extends between opposite contact ends 754, 756. The electrical contact 712 includes first and second body portions 746, 748 that are joined at the contact end 754 and are spaced apart from each other at the contact end 756. As shown, the body portions 746, 748 may extend parallel to one another. The contact body 752 also includes an engagement portion 764. The engagement portion 764 is a portion of the contact body 752 that is capable of mechanically and electrically engaging at least two types of electrical components. More specifically, the engagement portion 764 includes an IDC channel 774 and a spring member 776. The spring member 776 is stamped and formed from the body portion 748 and includes a contact beam 778 having a mating end 780. The IDC channel 774 may be configured to engage a respective wire conductor, such as the wire conductors 790 (FIG. 18). The IDC channel may be similar to the IDC channel 226 (FIG. 3) and others set forth herein. The spring member 776 is configured to engage a respective circuit board (not shown), which may be similar to the circuit boards described with respect to FIGS. 10-13. The spring member 776 may be similar to the spring member 228 (FIG. 3).

The contact body 752 may be sized and shaped relative to the contact cavity 734 (FIG. 18) in which the contact body 752 will be disposed. For example, the contact body 752 or the electrical contact 712 may be sized and shaped to be inserted into the contact cavity 734. In some embodiments, edges that define the contact body 752 may be configured to directly engage interior surfaces of the connector body 702 (FIG. 18) and form a frictional engagement therewith. In some cases, the contact body 752 may include a coupling projection 755 that is configured to directly engage the connector body 702. As shown, the coupling projection 755 is stamped-and-formed from the body portion 746. In the illustrated embodiment, the coupling projection 755 extends from a joint connected to a remainder of the body portion 746 toward the contact end 756. In other embodiments, the coupling projection 755 may extend from a joint connected to a remainder of the body portion 746 toward the contact end 754.

When the contact body 752 is fully formed, the spring member 776 may extend at an acute angle. The spring member 776 is in a relaxed condition in FIG. 19, but is capable of being deflected like other spring members set forth herein. When in a deflected condition, the spring member 776 provides a biasing force against the object that has deflected the spring members 776.

Figure 20:
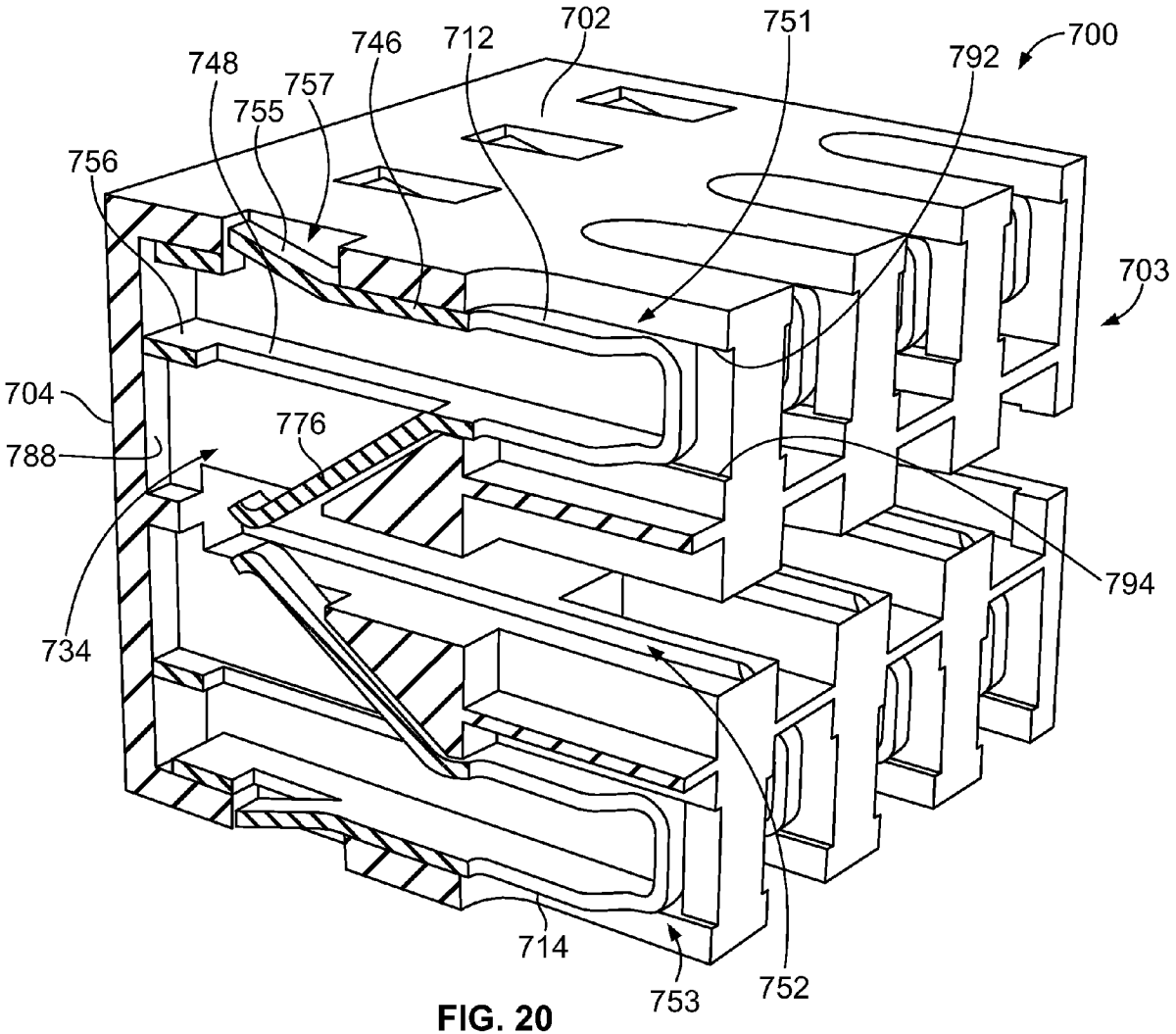
FIG. 20 illustrates a cross-section of the electrical connector of FIG. 18 showing component-receiving slots in greater detail.

FIG. 20 is a perspective cross-section of the electrical connector 700 illustrating component-receiving slots in greater detail. In particular, FIG. 20 shows the wire-receiving slots 751, 753 and the board-receiving slot 752 of the contact cavity 734. Although not indicated, the cross-section of the electrical connector 700 in FIG. 20 is taken along a wire (or first) plane, which may be similar to the wire plane 302 (FIG. 9). A board (or second) plane, which may be similar to the board plane 304 (FIG. 9), may intersect the connector body 702 and be oriented orthogonal to the wire plane.

In the illustrated embodiment, the wire-receiving slots 751, 753 and the board-receiving slot 752 are in fluid communication with one another through internal passages thereby forming the contact cavity 734. As described above, the contact cavity 734 may be in fluid communication with the contact cavity 732 (FIG. 19). Although the following description is with respect to the contact cavity 734, it may be similarly applied to the contact cavity 732. In other embodiments, however, one or more of the component-receiving slots may not be in fluid communication with one or more of the other component-receiving slots.

As shown, the connector body 702 may include an internal backstop 788. The internal backstop 788 may function as a positive stop that engages and prevents the circuit board(s) from moving further into the connector body 702. To insert the electrical contact 712, the electrical contact 712 may be configured such that the spring member 776 and the coupling projection 755 are in respective pre-formed conditions. More specifically, the spring member 776 and the coupling projection 755 may not be bent to project away from the body portions 748, 746, respectively. The contact end 756 may be initially inserted into corresponding wire-receiving slot 751 and advanced into the contact cavity 734 in a direction from the engagement side 703 to the back side 704. When the contact end 756 engages and is positioned against the internal backstop 788, the spring member 776 and the coupling projection 755 may be bent to the corresponding positions shown in FIG. 20. However, it is noted that FIG. 20 illustrates only one embodiment. For example, in other embodiments, the connector body 702 may be configured so that the spring member 776 and the coupling projection 755 may be in the relaxed conditions as shown in FIG. 20 as the electrical contact 712 is inserted into the contact cavity 734. As another example, the back side 704 may have openings that are sized and shaped to permit the electrical contact 712 to be inserted in a rear-to-front direction. In such embodiments, the connector body 702 may be shaped so that the contact end 754 engages a small stop at the engagement side 703 when the electrical contact 702 reaches an operative position.

When held by the connector body 702, the electrical contact 712 may engage ledge surfaces 792, 794 that partially define the wire-receiving slots 751. As shown, the coupling projection 755 may extend into a coupling opening 757 of the connector body 702. Surfaces of the connector body 702 that define the coupling opening 757 may engage the coupling projection 755 to prevent the electrical contact 712 from being inadvertently moved. The electrical contacts 714 may be positioned within the connector body 702 in a similar manner.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising: a connector body having an engagement side and a contact cavity that opens to the engagement side, the contact cavity including a wire-receiving slot that is shaped to receive a wire conductor and a board-receiving slot that is shaped to receive a circuit board, and an electrical contact held by the connector body within the contact cavity, the electrical contact including a spring member and an insulation displacement contact (IDC) channel, the spring member extending into the board-receiving slot to engage the circuit board, the IDC channel opening to the wire-receiving slot to receive the wire conductor, wherein insertion of the wire conductor or the circuit board into the respective wire-receiving slot or the board-receiving slot occurs at the engagement side of the electrical connector.

2. The electrical connector of claim 1, wherein the engagement side is a first engagement side and the connector body includes a second engagement side, wherein the contact cavity extends between the first and second engagement sides, the electrical contact including a bridge portion and first and second engagement portions that are joined by the bridge portion, the electrical contact being held by the connector body such that the first and second engagement portions are positioned proximate to the first and second engagement sides, respectively, the first engagement portion including the spring member and the IDC channel, the second engagement portion including at least one termination feature.

3. The electrical connector of claim 2, wherein the at least one termination feature includes another IDC channel and/or another spring member.

4. The electrical connector of claim 1, wherein the board-receiving slot and the wire-receiving slot are shaped such that the circuit board and the wire conductor are advanced into the board-receiving slot and the wire-receiving slot, respectively, along a common mating direction.

5. The electrical connector of claim 1, wherein the board-receiving slot and the wire-receiving slot coincide with board and wire planes, the board and wire planes being substantially orthogonal.

6. The electrical connector of claim 1, wherein the board-receiving slot and the wire-receiving slot are in fluid communication.

7. The electrical connector of claim 6 wherein the plurality of the electrical contacts include power contacts and signal contacts, the power and signal contacts having different dimensions.

8. The electrical connector of claim 1, wherein the electrical contact is configured to engage the wire conductor and the circuit board simultaneously.

9. The electrical connector of claim 1, further comprising a plurality of the electrical contacts, each of the electrical contacts of said plurality including a corresponding spring member and a corresponding IDC channel.

10. The electrical connector of claim 1, wherein the electrical contact includes first and second engagement portions and a bridge portion that joins the first and second engagement portions, the first engagement portion including the spring member and the IDC channel, the second engagement portion also including a spring member and an IDC channel, wherein the electrical contact is capable of forming an IDC-IDC interconnection, an IDC-PCB interconnection, and a PCB-PCB interconnection.

11. An electrical connector comprising:

a connector body having first and second engagement sides and a contact cavity that extends between the first and second engagement sides; and an electrical contact including a bridge portion and first and second engagement portions that are joined by the bridge portion, the electrical contact being disposed within the contact cavity and held by the connector body such that the first and second engagement portions are positioned proximate to the first and second engagement sides, respectively, the first engagement portion including a spring member and an insulation displacement contact (IDC) channel, the second engagement portion including at least one termination feature;

wherein the first engagement portion and the first engagement side form a first connector interface and the second engagement portion and the second engagement side form a second connector interface, the second connector interface configured to engage an electrical component, the first connector interface configured to receive a wire conductor within the IDC channel and engage a modular component with the spring member.

12. The electrical connector of claim 11, wherein the first engagement portion is configured to engage the wire conductor and receive the IDC channel simultaneously or separately.

13. The electrical connector of claim 11, wherein respective transmission pathways are established when the IDC channel receives the wire conductor and when the spring member is engaged to the modular component, each of the transmission pathways extending through the bridge portion to the at least one termination feature.

14. The electrical connector of claim 11, wherein the contact cavity forms a board-receiving slot and a wire-receiving slot along the first engagement side of the connector body, the IDC channel positioned to receive the wire conductor when the wire conductor is advanced into the wire-receiving slot, the spring member positioned to engage a circuit board when the circuit board is advanced into the board-receiving slot.

15. The electrical connector of claim 11, wherein the at least one termination feature includes another IDC channel and/or another spring member.

16. The electrical connector of claim 11, wherein the first and second engagement sides face in different directions.

17. An electrical contact comprising a single elongated contact body formed from conductive material, the contact body including separate first and second engagement portions and a bridge portion that extends between and joins the first and second engagement portions, each of the first and second engagement portions of the electrical contact including an insulation displacement contact (IDC) channel that is configured to receive a wire conductor, wherein at least one of the first and second engagement portions includes a resilient spring member that is configured to engage a circuit board; wherein the contact body has an operative height, an operative width, and an operative length, the first and second engagement portions having first and second contact ends, respectively, of the contact body, the operative length being measured between the first and second contact ends, the operative length being greater than the operative height and the operative width.

18. The electrical contact of claim 17, wherein each of the first and second engagement portions includes a resilient spring member that is configured to engage a corresponding circuit board, the spring members including respective mating ends, each of the mating ends representing a material end of the contact body.

19. An electrical contact comprising a single elongated contact body formed from conductive material, the contact body including first and second engagement portions and a bridge portion that joins the first and second engagement portions, each of the first and second engagement portions of the electrical contact including an insulation displacement contact (IDC) channel that is configured to receive a wire conductor, wherein at least one of the first and second engagement portions includes a resilient spring member that is configured to engage a circuit board;

wherein the first engagement portion includes the spring member, the second engagement portion also including a spring member such that the electrical contact is capable of forming an IDC-IDC interconnection, an IDC-PCB interconnection, and a PCB-PCB interconnection.

* * * * *